United States Patent [19]

Michelson

[11] Patent Number: 4,618,310

[45] Date of Patent: Oct. 21, 1986

[54] METHOD OF MULTI-STAGE COMPRESSOR SURGE CONTROL

[75] Inventor: Herbert D. Michelson, Fort Lee, N.J.

[73] Assignee: Exxon Research & Engineering Co., Florham Park, N.J.

[21] Appl. No.: 618,080

[22] Filed: Jun. 7, 1984

[51] Int. Cl.[4] ..... F04D 27/02

[52] U.S. Cl. ..... 415/1; 415/11; 415/47; 415/179

[58] Field of Search ..... 415/1, 11, 47, 53 R, 415/179; 60/39.29, 728

[56] References Cited

U.S. PATENT DOCUMENTS

| | | | |
|---|---|---|---|
| 3,292,845 | 12/1966 | Hens et al. | 415/11 |
| 3,947,146 | 3/1976 | Schauster | 415/1 |
| 4,156,578 | 5/1979 | Agar et al. | 415/1 |
| 4,203,701 | 5/1980 | Abbey | 415/11 |
| 4,230,437 | 10/1980 | Bellinger et al. | 415/1 |
| 4,362,462 | 12/1982 | Blotenberg | 415/179 |
| 4,417,847 | 11/1983 | Kube | 415/1 |

FOREIGN PATENT DOCUMENTS

| | | | |
|---|---|---|---|
| 53-62208 | 6/1978 | Japan | 415/179 |

*Primary Examiner*—Louis J. Casaregola

*Attorney, Agent, or Firm*—R. Yablonsky; F. A. Sinnock

[57] ABSTRACT

As an improvement in an anti-surge control method for a multi-stage centrifugal compressor having interstage coolers, this invention comprises, when there is an imbalance of stage flows relative to surge, replacing recycle with warm expanded gas to the maximum extent possible that still achieves an energy saving as compared with not effecting such replacement.

14 Claims, 4 Drawing Figures

ADDITIONAL EQUIPMENT FOR FIRST
STAGE SURGE CONTROL

METHOD OF MULTI-STAGE COMPRESSOR SURGE CONTROL

FIELD OF THE INVENTION

This invention relates to an improved anti-surge control method in which a saving in energy can be achieved. In particular, this invention relates to an improvement in existing anti-surge control methods used for controlling surge at reduced flow volume relative to design flow, where a multi-stage centrifugal gas compressor with interstage cooling means is provided with a recycle system for recycling a portion of the final stage discharge to the inlet of the first stage.

The gas undergoing compression may be air or any other common gas, for example fertilizer plant synthesis gas ($CO/H_2$ mixture). In particular, it may be a gaseous product, termed light ends, from a hydrocarbon conversion process such as thermal cracking, or catalytic cracking, especially thermal cracking in the presence of steam or in the presence of hydrogen and/or where a heat carrier is used comprising hot particulate solids. For example, a process for ethylene production is known wherein a suitable starting material such a naphtha or gas oil is cracked, the pyrolysis products are quenched and separated into fractions in a primary fractionator and cracked light ends are subsequently subjected to multi-stage compression before entering a low temperature separation section wherein low boiling hydrocarbons, such as ethylene, ethane, methane, as well as hydrogen are separated by rectification, see U.S. Pat. Nos. 3,947,146 and 4,417,847.

BACKGROUND OF THE INVENTION

As used herein, ACFM is a gas flow rate meaning actual cubic feet per minute, as opposed to standard cubic feet per minute. Surge point refers to a condition where a stage goes into surge. Approach to surge, as it implies, means closeness to surge. Imbalance of stage flows relative to surge means that the stages are at different approaches to surge. Design flow means the design flow rate to the inlet of the first stage and percentage of design flow means the percentage of design flow when that is considered as 100 percent. A selected percentage of design flow adequate to protect a stage from surge, means a flow rate (to the inlet of the first stage) which is considered to safely protect the stage in question from surge. A critical stage is any one which is closer to surge than one which is thus adequately protected. A limiting stage is the stage which is at the closest approach to surge and in conventional practice is the one that sets the rate of recycle.

When controlling surge by recycle according to the conventional practice, a description of which may be found in U.S. Pat. No. 4,230,437, a portion of the high pressure discharge gas stream is expanded and then recycled to the inlet of the first stage to provide for more volume. There is an energy penalty in the expansion and re-compression of this recycle stream. Furthermore, the various stages of the compressor will usually be at different approaches to surge but the recycle rate is set by the limiting stage, i.e., which is at the closest approach to surge and the other stages that may not need as much recycle to be protected receive unnecessary recycle as it passes through those other stage and has to be re-compressed. It follows that not only the necessary but the unnecessary portion of recycle has to be re-compressed, which wastes energy.

The percentage of design flow rate (to the first stage of the compressor) at which a stage goes into surge may differ for the various stages, simply because of the original design of the compressor and/or changes in operating conditions such as pressure. Stated differently, at a given percentage of design flow rate, the stages may each be at a different approach to surge. However, the approach to surge may be affected in another way. For example, if a particular stage other than the first stage receives an import of additional feed from another source, it will be put a further distance away from surge since it is receiving more volume than the percentage of design flow rate to the first stage. Thus, approach to surge may be a result of built in effects but it also may be manipulated, the term being used herein regardless of how achieved.

SUMMARY OF THE INVENTION

It has now been found that the same effect of providing for more volume can be achieved with a saving of energy by increasing the temperature of the gas flowing to the inlet of any critical stage thereby increasing the volume thereof. That is, the gas flow is adjusted by temperature control.

In one embodiment heating alone may be used, and in another embodiment a combination of heating and recycle.

The latter may be desirable when a recycle control system has already been installed; or when the gas has a fouling tendency which places a constraint on temperature. In this embodiment it is appropriate to use heating not further than the point where all stages are at the same approach to surge because when recycle is employed waste of energy results from an imbalance of stage flows relative to surge; thus recycle is substituted by warm expanded gas to the maximum extent possible that will still achieve a saving of energy.

In both embodiments heating may be done to put the critical stages at a more distant approach to surge; preferably to an extent which adequately and safely protects them from surge, e.g., so that all stages are at least 10 percent above surge; or so that said critical stages are substantially at the same approach to surge.

Frequently, the need for some type of intervention will arise when gas flow to the compressor is reduced below design flow and one or more stages becomes critical, which in commercial practice is usually considered to be when ACFM is less than 10 percent above ACFM at surge—although other suitable operating norms may be employed.

A compressor is generally provided with interstage coolers and heating of the gas to all but the first stage is easily accomplished by cutting down the flow of cooling water or cooling air to the heat exchangers. Further, the gas may emanate from a high temperature process and may pass through a cooler located ahead of the compressor. In such case heating of the gas to the first stage can be accomplished in a similar manner as for the other stages. If such cooler is lacking, then the gas to the first stage may simply be heated, for example by heat exchange with a hot stream. It may be noted that when means are provided for raising the temperature of the gas to each stage, recycle can be eliminated except in the circumstances described above.

Temperature increase may be achieved manually but preferably by automatic means, by throttling cooling water, taking a bank of coolers out of service or partially by-passing a bank of coolers, depending on the desired temperature increase.

When a combination of heating and recycle is employed, the method involves setting the recycle controller so that it prevents gas flow to the compressor from falling below a selected percentage of design flow that will safely and adequately protect the stage that is furthest away from surge; then, as flow to the compressor is reduced such that any of the other stages becomes critical, the gas passing to such critical stage is heated to put it at a more distant and preferably safe approach to surge. This step can be repeated if necessary until the stages are matched, viz., so that there is esentially no imbalance between stages. It is only when flow to the compressor drops further, viz., to below said selected percentage of design flow, that the recycle controller is actuated in response to a signal from a flow meter and causes recycle to commence. However, at this condition recycle does not result in waste of energy. It may be noted, therefore, that according to the subject invention the recycle system is geared to the stage that is furthest away from surge in contrast to the conventional method in which it is geared to the limiting stage, i.e., the one that is closest to surge. The reason is that in the method of the invention the gas to any stage which is critical is heated until a point is reached where the stage that was furthest away from surge itself becomes critical and it is then that recycle is started. That is to say, the recycle controller in its dual capacity will (a) initiate recycle when the stage furthest from surge is no longer safely protected, e.g., 10 percent above surge, and will (b) actuate a temperature controller for any critical stage to increase volume thereto so that it is safely protected, e.g., 10 percent above surge, before any occurrence of recycle.

BRIEF DESCRIPTION OF THE DRAWINGS

The invention is illustrated by the drawings in which.

DETAILED DESCRIPTION

For an explanation of the theory of the invention, an exemplary comparison is described in connection with FIGS. 1 and 2.

A multi-stage compressor 1 is equipped with interstage coolers 2 and knockout drums 3. The purpose of the coolers is to reduce the volume and minimize the horsepower during normal operation. The knockout drum traps condensate so that liquid does not enter the next stage. At reduced flow volumes, typically 60–70 percent of design, stages of the compressor go into surge, a regime in which there are violent pressure fluctuations that could damage the machine. For this reason recycle line 4 is provided to keep the flow above the volume that would cause surge.

Figure 1:
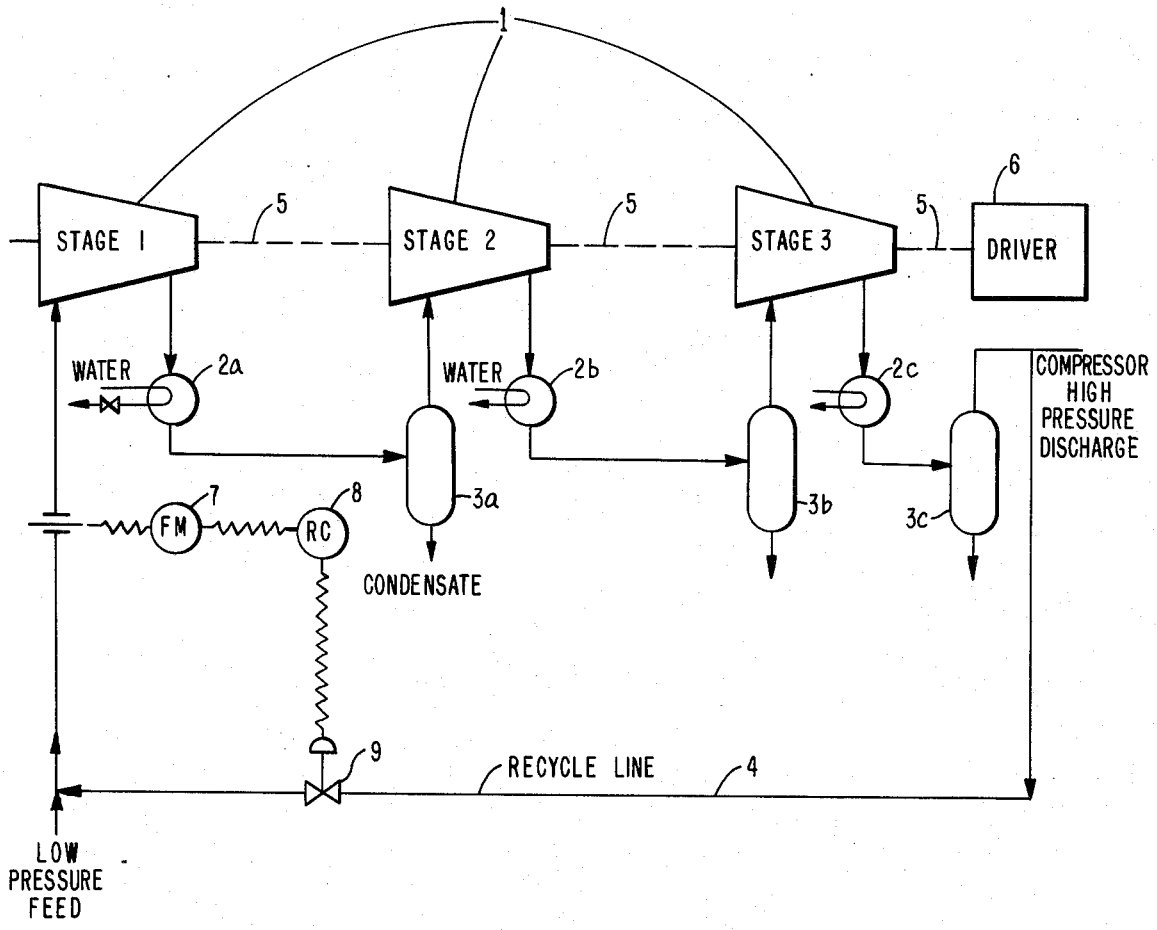
PRIOR ART FIG. 1
FIG. 1 is a diagrammatic representation of a prior art surge control system for a compressor.

Case 1 with FIG. 1: a three-stage compressor 1 is mounted on a shaft 5 and driven by a driver 6. The three stages have surge points respectively at 62%, 67% and 65% of the design volume inlet flow to the first stage. It is common industry practice to keep the flow 10% above the surge point of the most critical stage, in this case stage 2. Therefore, inlet flow as measured by flow meter 7 will be kept from falling below 73.7% of design flow by the action of recycle controller 8 opening recycle control valve 9.

While stage 2 flow is kept 10% above surge, stages 1 and 3 are 18.9% and 13.4% above surge respectively, more than is needed and wasteful. The purpose of the invention is to increase the volume of the critical stages by raising their temperatures until all the stages are only 10% above surge. It is only at this point that any further decrease in inlet flow would result in the recycle system being actuated.

Figure 2:
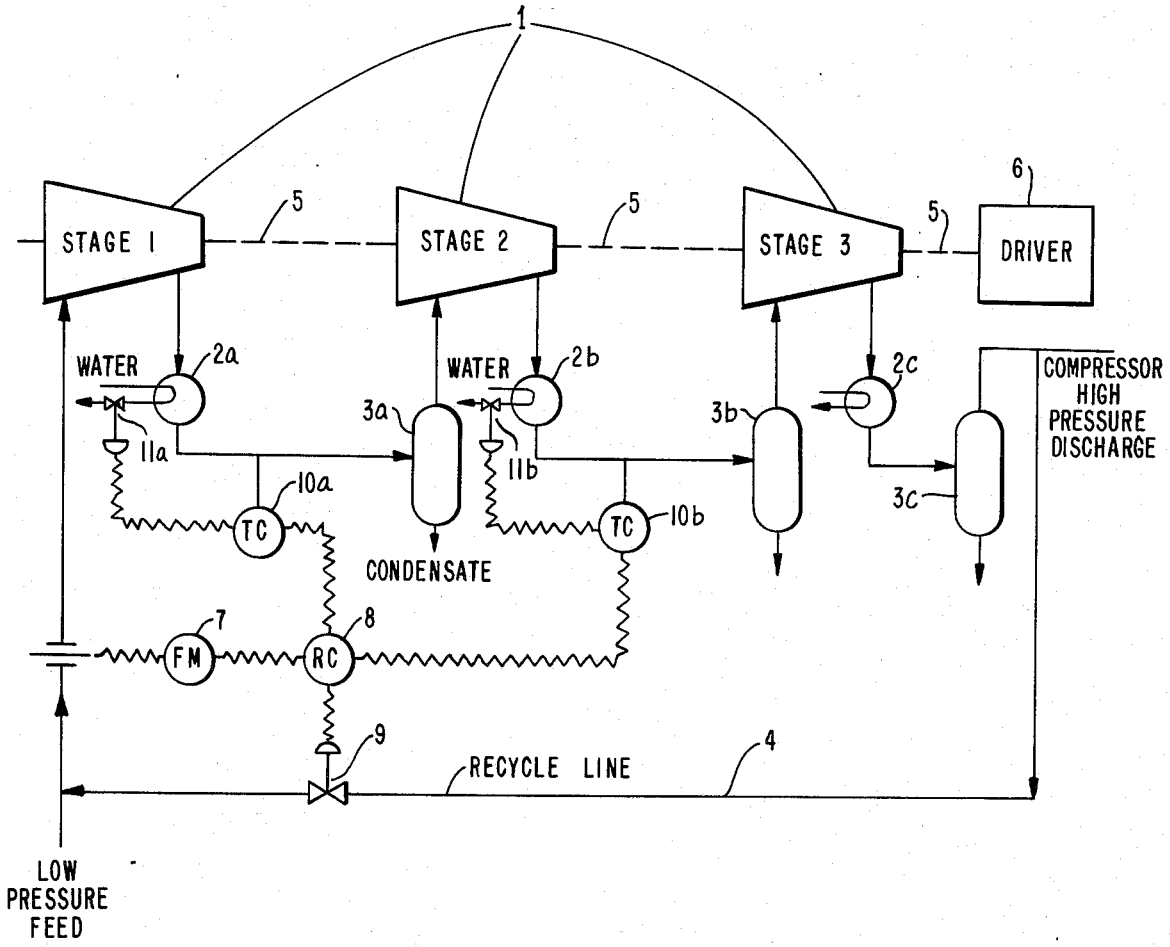
FIG. 2 is a diagrammatic representation of a surge control system for a compressor of the present invention.

Case 2 with FIG. 2: This would be accomplished by giving the recycle controller 8 additional functions (besides initiating recycle) and adding temperature controllers 10 and cooling water control valves 11. The recycle controller 8 would be set to keep inlet flow volume from falling below 68.2% of design flow to provide the first stage with 10% more flow than its surge point. However, this provides the second and third stages with only 1.8% and 4.9% margins above their respective surge points. The difference is made up by raising the temperature and therefore the volume to the second and third stages. In the case of the second stage, as soon as the measured inlet flow measured by flow meter 7 dropped below 73.7%, the recycle controller 8 would increase the inlet temperature to stage 2 by resetting temperature controller 10*a* which in turn reduces the water flow through control valve 11*a* according to the formula:

$$\frac{T(10a)\text{ set point}}{T(10a)\text{ design}} = \frac{73.7\%\text{ Flow (7) design}}{\text{Flow (7) actual}}$$

Thus the absolute temperature is increased in direct proportion to the shortfall of the inlet volume measured by flow meter 7 below the 73.7% of design rate that is needed to protect the second stage against surge thereby providing the additional volume through temperature expansion. Similarly the third stage temperature controller 10*b* would be reset according to the equation:

$$\frac{T(10b)\text{ set point}}{T(10b)\text{ design}} = \frac{71.5\%\text{ Flow (7) design}}{\text{Flow (7) actual}}$$

That is, the recycle controller resets the temperature controller so that the ratio of the reset temperature of the cooling water to a stage, to the design temperature, is equal to the ratio of a selected percentage of design flow which protects that stage from surge, to the actual flow to the compressor.

These formulas provide the desired 10-percent margin over surge when there is no change in the amount condensed in the interstage cooler. Actually, increasing interstage temperature results in less material being condensed so that the margin is higher. If desired, a more sophisticated controller could be used to calculate this effect. However, directionally the formulas are dependable since the margin provided will always be at least sufficient.

The surge point in a compressor in actuality is a function also of the pressure and molecular weight and recent techniques are now used by some to calculate it as discussed in an article by John R. Gaston in Chem. Engineering Apr. 19, 1982, pp. 139–147, rather than the original method of defining it as the volume that causes surge at the worst combination of pressure and molecular weight that the machine may see. Nevertheless, the invention applies to any machine that has a disparity in surge flows between stages no matter how defined or calculated.

To demonstrate the effect of this control scheme, increasing suction temperature of the limiting stages is evaluated for compression of the gaseous effluent of a steam cracking process in a process gas compressor when cracking EP (ethane-propane) mix and propane and importing 20 klbs/hr (K=1000) of catalytically cracked $C_2$'s to the third stage. The compressor is made up of two joined compressors designated LC01 and $LCO_2$ that effectively act as a single compressor with five stages. The first three stages are protected against surge by recycling from the third stage discharge to the first stage suction. The fourth and fifth stages are protected against surge by recycling from the fifth stage discharge to the fourth stage suction.

As shown in Table 1, at an ethylene production of 123.8 klbs/hr, the second stage is on the verge of requiring recycle at 110% of surge whereas the third stage is at 129% of surge. Thus, if suction temperatures were maintained, there would be unnecessary recycle through the third stage at ethylene production less than 123.8 klbs/hr. The fourth and fifth stage approach to surge are essentially the same so that recycle does not result in unnecessary energy loss.

As shown in Table 2, by increasing the second stage temperature from 100° F. to 120° F. and the first stage from 95° F. to 120° F. the compressor can turn down to an ethylene production of 112.1 klbs/hr (10% reduction) before recycle is necessary. A 120° F. suction temperature is judged reasonable for this gas. Operating at these higher temperatures saves 904 HP (horsepower) at an ethylene production of 112 klbs/hr or less.

The energy credits for this method depend on the imbalance of stage flows relative to surge and ACFM increase that can be achieved by increasing temperature. The increase of ACFM depends upon the difference between normal operating temperature and maximum allowable temperature as affected by fouling of the gas. Also, the flow increase achieved by raising temperature depends upon the location of the limiting stage and the steam cracker feed. At the low pressure end of the compressor, increasing temperature has a greater effect on ACFM because temperature has more of an effect on the quantity of steam in the vapor. The effect of increasing temperature on ACFM is greater for liquids crackers than NGL (natural gas liquids, e.g., ethane-propane mix) crackers because temperature has a greater effect on the amount of $C_5$+ material in the vapor.

TABLE 1

PROCESS GAS COMPRESSOR
ETHYLENE PRODUCTION = 123.8 KLBS/HR(1)

| | LCO1 | | | LCO2 | |
|---|---|---|---|---|---|
| Stage | 1 | 2 | 3 | 4 | 5 |
| MOLS/HR | 6981 | 14022 | 14574 | 15050 | 14858 |
| M.W. (molecular Weight) | 21.3 | 22.9 | 23.2 | 22.2 | 21.8 |
| ACFM | 40616 | 38810 | 18082 | 8714 | 4483 |
| ACFM @ Surge | 36058 | 35282 | 1400 | 7885 | 4075 |
| ACFM/ ACFM @ Surge | 1.13 | 1.10 | 1.29 | 1.10 | 1.10 |

TABLE 1-continued

PROCESS GAS COMPRESSOR
ETHYLENE PRODUCTION = 123.8 KLBS/HR(1)

| | LCO1 | | | LCO2 | |
|---|---|---|---|---|---|
| Stage | 1 | 2 | 3 | 4 | 5 |
| $P_{suct}/P_{disch}$, psia | 17/36.4 | 35.9/81.6 | 80.0/170 | 166/322 | 310/595 |
| $T_{suct}/T_{disch}$, °F. | 95/207 | 100/217 | 105/219 | 95/191 | 95/198 |
| Speed, RPM | | ← 3966 → | | ← 6157 → | |
| Efficiency, % | 76.7 | 77.6 | 72.1 | 76.7 | 72.4 |
| Gas HP | 3287 | 7115 | 7264 | 5936 | 6037 |
| Total Gas HP | | | 32926 | | |
| LCO1 Recycle, MPH (moles per hr.) | 0 | | | | |
| LCO2 Recycle, MPH | 720 | | | | |

(1)Steam cracking feeds are EP mix = 150 klbs/hr, propane = 134.4 klbs/hr and catalytically cracked $C_2$ imports = 20 klbs/hr.

TABLE 2

EFFECT OF ANTI-SURGE CONTROL BY RAISING TEMPERATURES ON A PROCESS GAS COMPRESSOR CONSTANT SPEED
ETHYLENE PRODUCTION = 112.1 KLBS/HR(1)

| | LCO1 | | | LCO2 | |
|---|---|---|---|---|---|
| Stage | 1 | 2 | 3 | 4 | 5 |
| | BASE CONDITIONS | | | | |
| MOLS/HR | 6983 | 14015 | 14545 | 15033 | 14848 |
| M.W. | 21.4 | 22.9 | 23.2 | 22.2 | 21.8 |
| ACFM | 40626 | 38751 | 17987 | 8687 | 4476 |
| ACFM @ Surge | 36004 | 35228 | 13979 | 7873 | 4069 |
| ACFM/ ACFM @ Surge | 1.13 | 1.10 | 1.29 | 1.10 | 1.10 |
| $P_{suct}/P_{disch}$, psia | 17/36.4 | 35.9/81.9 | 80.3/171 | 166/322 | 310/595 |
| $T_{suct}/T_{disch}$, °F. | 95/207 | 100/217 | 105/219 | 95/191 | 95/198 |
| Speed, RPM | | ← 3960 → | | ← 6146 → | |
| Efficiency, % | 76.7 | 77.6 | 72.1 | 76.7 | 72.4 |
| Gas HP | 3296 | 7124 | 7228 | 5923 | 6016 |
| Total Gas HP | | | 32883 | | |
| LCO1 Recycle, MPH | 1390 | | | | |
| LCO2 Recycle, MPH | 2080 | | | | |
| | ANTI-SURGE CONTROL BY RAISING TEMPERATURES | | | | |
| MOLS/HR | 6610 | 13219 | 13201 | 15024 | 14836 |
| M.W. | 21.0 | 24.2 | 23.3 | 22.3 | 21.8 |
| ACFM | 39612 | 38819 | 16456 | 8694 | 4475 |
| ACFM @ Surge | 36004 | 35228 | 13979 | 7871 | 4068 |
| ACFM/ ACFM @ Surge | 1.10 | 1.10 | 1.185 | 1.10 | 1.10 |
| $P_{suct}/P_{disch}$, psia | 17.2/35.5 | 35.0/81.2 | 79.6/170 | 166/322 | 310/595 |
| $T_{suct}/T_{disch}$, °F. | 120/231 | 120/238 | 105/221 | 95/191 | 95/198 |
| Speed, RPM | | ← 3960 → | | ← 6146 → | |
| Efficiency, % | 76.4 | 77.6 | 70.5 | 76.7 | 72.4 |
| Gas HP | 3084 | 7096 | 6781 | 5921 | 6013 |
| Total Gas HP | | 31979 | | | |
| LCO1 Recycle, | 0.0 | | | | |

TABLE 2-continued

EFFECT OF ANTI-SURGE CONTROL BY RAISING TEMPERATURES ON A PROCESS GAS COMPRESSOR CONSTANT SPEED ETHYLENE PRODUCTION = 112.1 KLBS/HR[1]

| | LCO1 | | | LCO2 | |
|---|---|---|---|---|---|
| Stage | 1 | 2 | 3 | 4 | 5 |
| MPH LCO2 Recycle, MPH | 2050 | | | | |

[1]Steam cracking feeds are EP mix = 150 klbs/hr, propane = 104.0 klbs/hr and catalytically cracked $C_2$ imports = 20 klbs/hr.

Most multi-stage centrifugal compressors are conventionally protected against surge at low capacity by recycling the final stage discharge to the intake of the first stage. If only one of the stages is approaching surge, there is a waste of horsepower. Many plant managers are contemplating installation of individual stage recycle valves and piping.

As an alternative to individual stage recycle anti-surge control, the temperature of the gas to one or more stages can be raised to provide more volume and avoid surge. Temperature control can save more horsepower than individual stage recycle.

Table 3 presents a comparison of compressor performance at constant pressure of the gas to the inlet of the first stage and shows that temperature control saves 228 HP as compared with individual stage recycle on the first and second stages.

TABLE 3

EFFECT OF ANTI-SURGE CONTROL BY RAISING TEMPERATURES ON PROCESS GAS COMPRESSOR COMPARISON WITH INDIVIDUAL STAGE RECYCLE ON THE FIRST AND SECOND STAGES ETHYLENE PRODUCTION = 111.7 KLBS/HR[1]

| | LCO1 | | | LCO2 | |
|---|---|---|---|---|---|
| Stage | 1 | 2 | 3 | 4 | 5 |
| | BASE CONDITIONS-INDIVIDUAL STAGE RECYCLE | | | | |
| MOLS/HR | 6812 | 13958 | 13133 | 15060 | 14875 |
| M.W. | 21.2 | 22.9 | 23.2 | 22.3 | 21.8 |
| ACFM | 39634 | 38780 | 16294 | 8731 | 4480 |
| ACFM @ Surge | 36031 | 35255 | 14000 | 7880 | 4072 |
| ACFM/ACFM @ Surge | 1.10 | 1.10 | 1.16 | 1.11 | 1.10 |
| $P_{suct}/P_{disch}$, psia | 17.0/36.3 | 35.8/81.4 | 79.8/170 | 166/322 | 310/595 |
| $T_{suct}/T_{disch}$, °F. | 95/208 | 100/217 | 105/222 | 95/192 | 95/198 |
| Speed, RPM | | ← 3963 → | | ← 6153 → | |
| Efficiency, % | 76.4 | 77.6 | 70.3 | 76.7 | 72.4 |
| Gas HP | 3208 | 7059 | 6716 | 5944 | 6046 |
| Total Gas HP | | | 32181 | | |
| LCO1 Recycle, MPH | 1160 (1st stage), 1410 (2nd stage) | | | | |
| LCO Recycle, MPH | 2140 | | | | |
| | ANTI-SURGE CONTROL BY RAISING TEMPERATURES | | | | |
| MOLS/HR | 6553 | 13113 | 13128 | 15015 | 14826 |
| M.W. | 21.0 | 24.0 | 23.3 | 22.3 | 21.8 |
| ACFM | 39743 | 38865 | 16533 | 8756 | 4491 |
| ACFM @ Surge | 36131 | 35353 | 14028 | 7901 | 4083 |
| ACFM/ACFM @ | 1.10 | 1.10 | 1.18 | 1.11 | 1.10 |

TABLE 3-continued

EFFECT OF ANTI-SURGE CONTROL BY RAISING TEMPERATURES ON PROCESS GAS COMPRESSOR COMPARISON WITH INDIVIDUAL STAGE RECYCLE ON THE FIRST AND SECOND STAGES ETHYLENE PRODUCTION = 111.7 KLBS/HR[1]

| | LCO1 | | | LCO2 | |
|---|---|---|---|---|---|
| Stage | 1 | 2 | 3 | 4 | 5 |
| Surge $P_{suct}/P_{disch}$, psia | 17/35.2 | 34.7/80.5 | 78.9/169 | 165/321 | 309/595 |
| $T_{suct}/T_{disch}$, °F. | 118/229 | 120/238 | 105/219 | 95/191 | 95/198 |
| Speed, RPM | | ← 3974 → | | ←6169 → | |
| Efficiency, % | 76.4 | 77.6 | 70.5 | 76.7 | 72.4 |
| Gas HP | 3081 | 7024 | 6760 | 5954 | 6053 |
| Total Gas HP | | | 31953 | | |
| LCO1 Recycle, MPH | 0.0 | | | | |
| LCO2 Recycle, MPH | 2100 | | | | |

[1]Steam cracking feeds are EP mix = 150 klbs/hr, propane = 102.9 klbs/hr and catalytically cracked $C_2$ imports = 20 klbs/hr to the third stage.

Figure 3:
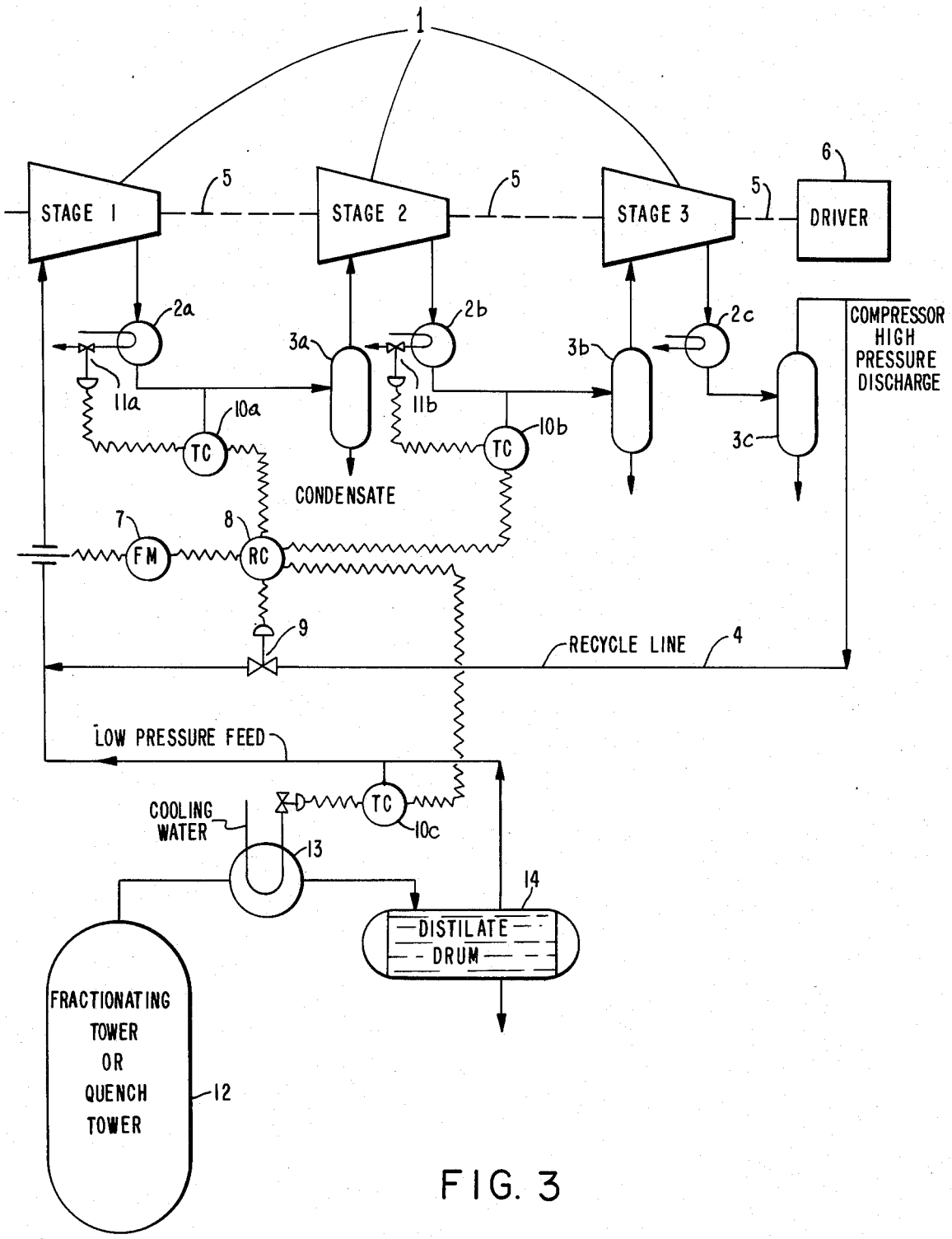
FIG. 3 is similar to FIG. 2 but shows additional equipment for first stage surge control.

FIG. 3 illustrates schematically apparatus and operation thereof for a case where the first stage is the critical stage where it is desired to increase the inlet volume to that stage without having to recycle through all stages. In the diagram of FIG. 3, low pressure feed gas comes from a steam cracker having a fractionator or quench tower 12 through a cooler 13 into a distillate drum 14. Analogously to the operation of FIG. 2, when flow meter 7 senses insufficient flow to keep the first stage safely above surge, recycle controller 8 resets temperature controller 10*c* to reduce the cooling water so that the volume increases.

Figure 4:
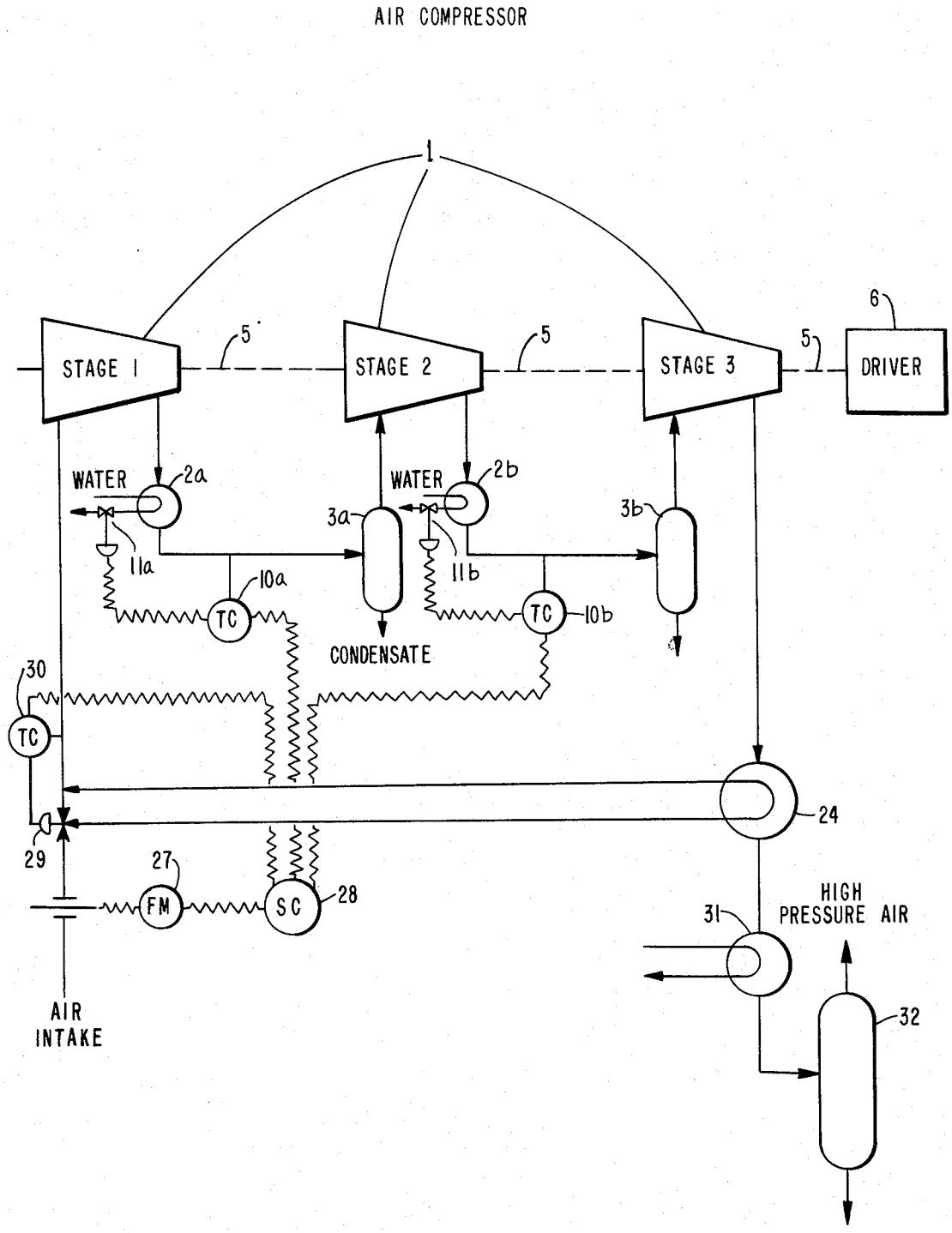
FIG. 4 is a diagrammatic representation of an air compressor of the present invention.

Now that the first stage is also protected, the recycle line may be eliminated. FIG. 4 shows such a system as it applies to an air compressor. The interstage coolers operate exactly as described in connection with FIG. 2. An explanation for the first stage follows. Flow meter 27 measures the air flow to the compressor and sends its measurement to surge controller 28. If the volume falls below the level needed to safely keep the first stage above surge, it signals temperature controller 30 to increase the inlet temperature. This is accomplished by changing the position of three way control valve 29 so that some of the inlet air is directed to heat exchanger 24 where it is warmed by the discharge of the last stage.

Stages 2 and 3 are protected by the surge controller 28 in a manner analogous to that shown in FIG. 2.

It can thus be seen that the invention is a step forward in compressor surge control because it accomplishes control while achieving energy conservation. Apparatus and installation thereof are not complex; investment cost is low.

What is claimed is:

1. An improvement in an anti-surge control method for a multi-stage centrifugal compressor having interstage cooling means which comprises, when the stages are at different approaches to surge, controlling the temperature of the gas flowing to the inlet of any critical stages thereby allowing the gas to heat up to increase the volume thereof so that said critical stages are put at a more distant approach to surge.

2. The method according to claim 1 in which volume is increased sufficiently so that said critical stages are adequately protected against surge.

3. The method according to claim 1 in which volume is increased sufficiently so that all stages are at least 10 percent above surge.

4. The method according to claim 2 in which volume is increased so that said critical stages are substantially at the same approach to surge.

5. The method according to claim 2 in which temperature control includes throttling of interstage cooling means.

6. An improvement in an anti-surge control method for a multi-stage centrifugal compressor having interstage cooling means and in which there is an imbalance of stage flows relative to surge, which comprises providing means whereby a flow meter can sense insufficient flow to keep a stage safely above surge;

said flow meter signals a recvcle or surge controller; and said recycle or surge controller resets a temperature controller on the gas flowing to said stage thereby allowing the gas to said stage to heat up to increase the volume thereof sufficiently so that said stage is safely protected against surge.

7. The method according to claim 6 in which a surge controller is provided and heating of the gas is accomplished by throttling an interstage cooler or heating the gas flowing to the first stage by heat exchange with a hot stream.

8. An improvement in an anti-surge control method for a multi-stage centrifugal compressor having interstage cooling means and in which there is an imbalance of stage flows relative to surge, which comprises controlling the temperature of the gas flowing to the inlet of any critical stage by means of a recycle controller, in response to a signal from a flow meter sensing insufficient flow to keep said stage safely above surge, resetting a temperature controller on the gas flowing to said stage thereby allowing the gas to heat up to increase the volume thereof sufficiently so that said stage is safely protected against surge.

9. The method according to claim 8 in which heating is accomplished by throttling an interstage cooler or a cooler located ahead of the first stage.

10. The method according to claim 8 in which recycle is not initiated before all stages have been brought to substantially the same approach to surge.

11. An improvement in an anti-surge control method for a multi-stage centrifugal compressor having interstage cooling means which comprises, in the event that gas flow to the compressor is reduced below design flow and the stages are at different approaches to surge, controlling the temperature of the gas flowing to the inlet of any critical stages thereby allowing the gas to heat up to increase the volume thereof so that said critical stages are put at a more distant approach to surge.

12. In an anti-surge control method for a multi-stage centrifugal gas compressor having interstage cooling means and a recycle system, the improvement which comprises:

A. setting the recycle controller to prevent flow to the compressor from falling below a selected percentage of design flow adequate to protect the stage which is furthest away from surge; and B. raising the temperature of the gas flowing to the inlet of any critical stage to increase volume thereof to adequately protect it from surge, before any occurrence of recycle.

13. In an anti-surge control method for a multi-stage centrifugal gas compressor having interstage cooling means and a recycle system, the improvement which comprises:

A. setting the recycle controller to prevent flow to the compressor from falling below a selected percentage of design flow adequate to protect the stage which is furthest away from surge; and B. raising the temperature of the gas flowing to the inlet of any critical stage to increase volume thereof such that the ratio of the raised temperature (absolute) to the design temperature is equal to the ratio of a selected percentage of design flow adequate to protect that stage from surge, to the actual flow, before any occurrence of recycle.

14. The method according to claim 1 or 8 in which the gas undergoing compression comprises the light ends from the steam cracking of hydrocarbons.

* * * * *